US005453664A

United States Patent [19]

Harris

[11] Patent Number: 5,453,664

[45] Date of Patent: Sep. 26, 1995

[54] LIGHT STRING WITH IMPROVED SHUNT SYSTEM

[76] Inventor: Geoffrey H. Harris, 2954 W. Logan Blvd., Chicago, Ill. 60647

[21] Appl. No.: 189,926

[22] Filed: Feb. 1, 1994

[51] Int. Cl.[6] ..... H05B 37/02

[52] U.S. Cl. ..... 315/185 S; 315/225

[58] Field of Search ..... 315/185 R, 185 S, 315/225, 226

[56] References Cited

U.S. PATENT DOCUMENTS

| | | | |
|---|---|---|---|
| 1,152,228 | 9/19/5 | Waters | 176/24 |
| 1,510,847 | 10/1924 | Holler | 315/185 R |
| 1,803,486 | 5/1931 | Rau, Jr. | 315/71 |
| 1,807,588 | 6/1931 | Eckstein | 176/24 |
| 1,868,689 | 7/1932 | Brander | 315/122 |
| 1,954,355 | 4/1934 | Handy | 176/24 |
| 2,072,337 | 3/1937 | Kamm | 176/24 |
| 2,211,884 | 8/1940 | Davis | 176/24 |
| 2,295,652 | 9/1942 | Hageman et al. | 176/30 |
| 2,332,116 | 10/1943 | Schmid | 176/24 |
| 2,484,596 | 10/1949 | Waltz | 201/49 |
| 2,576,363 | 11/1951 | Rively et al. | 315/122 |
| 2,870,377 | 1/1959 | Ovrevik | 315/92 |
| 3,345,482 | 10/1967 | Lou | 200/118 |
| 3,359,523 | 12/1967 | Lou | 338/70 |
| 4,241,387 | 12/1980 | Bowers | 362/252 |
| 4,991,071 | 2/1991 | Braasch | 315/185 S |

*Primary Examiner*—Robert J. Pascal
*Assistant Examiner*—Michael B. Shingleton
*Attorney, Agent, or Firm*—Lockwood, Alex, FitzGibbon & Cummings

[57] ABSTRACT

A decorative light string having a bulb shunt system is described. The light string includes a plurality of light bulbs positioned within their respective sockets along a power line and in a series circuit. The shunt system includes at least two shunt members associated with each bulb/socket combination wherein a first shunt is positioned within the bulb envelope while a second shunt is positioned outside of the envelope, either in association with the lamp holder or within the socket. The combined initial resistance of the two shunts is preferably greater than the resistance of the bulb filament and the system is configured to shunt the electric current passing through the bulbs in the event of filament breakage and, in one embodiment, in the event the bulb member is removed from its associated socket.

20 Claims, 2 Drawing Sheets

LIGHT STRING WITH IMPROVED SHUNT SYSTEM

The present invention relates to a decorative light string having a shunt system associated therewith. More specifically, the invention relates to a series circuit light string having an improved bulb shunt system associated with each of the bulb/socket combinations along the string. The invention is applicable to decorative light strings of various configurations and especially miniature Christmas lights connected in a series circuit.

BACKGROUND OF THE INVENTION

Decorative miniature lights such as miniature Christmas lights are assembled into light strings and, the typical arrangement has the lights connected in a series circuit. Although these light strings are relatively easy and inexpensive to manufacture, certain drawbacks and shortcomings are inherent in the design most common to the art. Since the light string is connected in series, the failure of a single bulb in the string will open the circuit and simultaneously cause all the other bulbs in the string to fail.

Attempts to prevent string failure in series circuit light strings have included the use of a single shunt in association with each bulb and socket combination. The single shunt is typically positioned directly within the glass envelope of each bulb in the string, making the effectiveness of the shunt depend on the presence at all times of a bulb within each of the bulb sockets in the string. In operation, the shunt provides an alternate path through which electric current will flow in the event of bulb failure. After bulb failure and as long as the bulb remains in the string, the shunt allows current to continue to flow through the bulb, thereby maintaining the circuit in a closed condition to prevent the failure of the entire light string.

Single shunts of the type mentioned above, however, have not been entirely satisfactory. For example, when a bulb in the string is crushed during installation or shipping, the bulb shunt is often damaged or broken and, thereafter, is ineffective in preventing string failure. Additionally, during installation of a light string on a Christmas tree, for example, bulbs on the string are often twisted, causing the lead wires of the bulb to either break or to move off of the electrical terminals within the socket. Since these events will interrupt the flow of current through the bulb and damage the associated shunt, the placement of a single shunt within the bulb envelope has been ineffective in preventing the failure of the entire light string under the aforementioned conditions. String failure will also occur if a single bulb, and its associated shunt, falls out of or is otherwise removed from its socket.

It would, therefore, be desirable to have a series circuit light string with a shunt system that is effective in preventing the failure of the entire light string when any one bulb is removed from its socket or when the bulb envelope and the single shunt therein is crushed or is otherwise broken. It would also be desirable to provide a shunt system effective in preventing the failure of the entire string should a single bulb become twisted within its socket.

It is an object of the present invention to provide a light string connected in a series circuit and having a bulb shunt system.

It is another object of the invention to provide a bulb shunt system in a series circuit light string wherein the shunt system is constructed to prevent the failure of the entire light string when any individual light bulb fails.

It is yet another object of the invention to provide a bulb shunt system for a light string wherein the shunt system includes multiple shunts with at least one shunt positioned outside of the bulb envelope.

It is still another object of the invention to provide a bulb shunt system that prevents the failure of the entire light string when individual bulbs on the string are removed, broken or are otherwise disconnected from the circuit.

These and other objects and advantages of the invention will be more fully appreciated by those skilled in the art upon the further consideration of the remaining disclosure, including the summary and the detailed description of the invention along with the associated drawings and the appended claims.

SUMMARY OF THE INVENTION

The present invention overcomes the aforementioned shortcomings of the art by providing a light string connected in series and including a bulb shunt system. The light string includes a plurality of light bulbs positioned within their respective sockets along a power line and in a series circuit. Each of the bulb/socket combinations in the light string includes a shunt system having at least two shunts. In a preferred embodiment, a first shunt is positioned within each of the bulb envelopes while the second shunt is positioned outside of each bulb envelope. The two shunts preferably have a combined initial resistance greater than the resistance of the bulb filament and, the system is configured to shunt the electric current passing through the bulbs should any particular filament break. The shunt within the bulb envelope in such a dual shunt system is effective in dissipating heat to thereby prevent excessive heat build-up at the location of the second shunt. Additionally, the shunt within the bulb envelope can serve as a back-up if the second shunt becomes contaminated or otherwise rendered non-conducting.

In one aspect of the invention, a first shunt is located within the bulb envelope and a second shunt is positioned outside of the envelope and across the bulb lead wires. In this arrangement, the second shunt will maintain the circuit in a closed condition if the bulb is broken or if the bulb is twisted within the socket.

In another aspect of the invention, a second shunt wire is wrapped around the base of the lampholder connecting the bulb terminal wires when the bulb is positioned within a lampholder. In this arrangement, the second shunt will prevent failure of the bulb string when the bulb is broken or becomes twisted within the socket to either break the bulb lead wires or move them off of the electrical terminals within the socket.

In still another aspect of the invention, the second shunt is placed within the socket and across the terminal wires. The placement of the second shunt within the socket solves the additional problem of maintaining the circuit in a closed condition when the bulb is removed from or falls out of the socket. This arrangement is also effective in preventing circuit failure when the bulb is broken or when the bulb is twisted within the socket in such a manner that the lead wires are broken or are moved out of contact with the electrical terminals within the socket.

In all of the above aspects of the invention, the first shunt is located within the bulb envelope to assist in maintaining a closed circuit in the event of bulb failure. The two shunts are preferably of a combined initial resistance which is greater than the resistance of the bulb filament and the first shunt is effective to dissipate heat within the envelope when the filament breaks, thereby avoiding heat buildup at the second shunt outside the bulb envelope. The shunts are preferably made with breakdown materials to avoid accidental short circuiting of the bulb and to provide a lowered resistance following a breakdown of the insulating materials associated with the shunts.

BRIEF DESCRIPTION OF THE DRAWINGS

In describing the structural aspects of the invention, reference is made to the various figures, wherein.

DETAILED DESCRIPTION OF THE INVENTION

The present invention provide a decorative light string having a shunt system associated with each of the individual lamp/socket combinations in a serially connected string. The shunt system includes a first shunt within the bulb envelope and a second shunt outside the envelope across the bulb lead wires or in the socket and across the terminal wires therein. If any individual lamp should fail, the shunts allow current to flow through the lamp/socket to thereby prevent the failure of the entire lamp string in the series circuit. The shunts are effective to prevent string failure when an individual lamp "burns out" is broken or, in one aspect, is removed from its associated socket.

Figure 1:
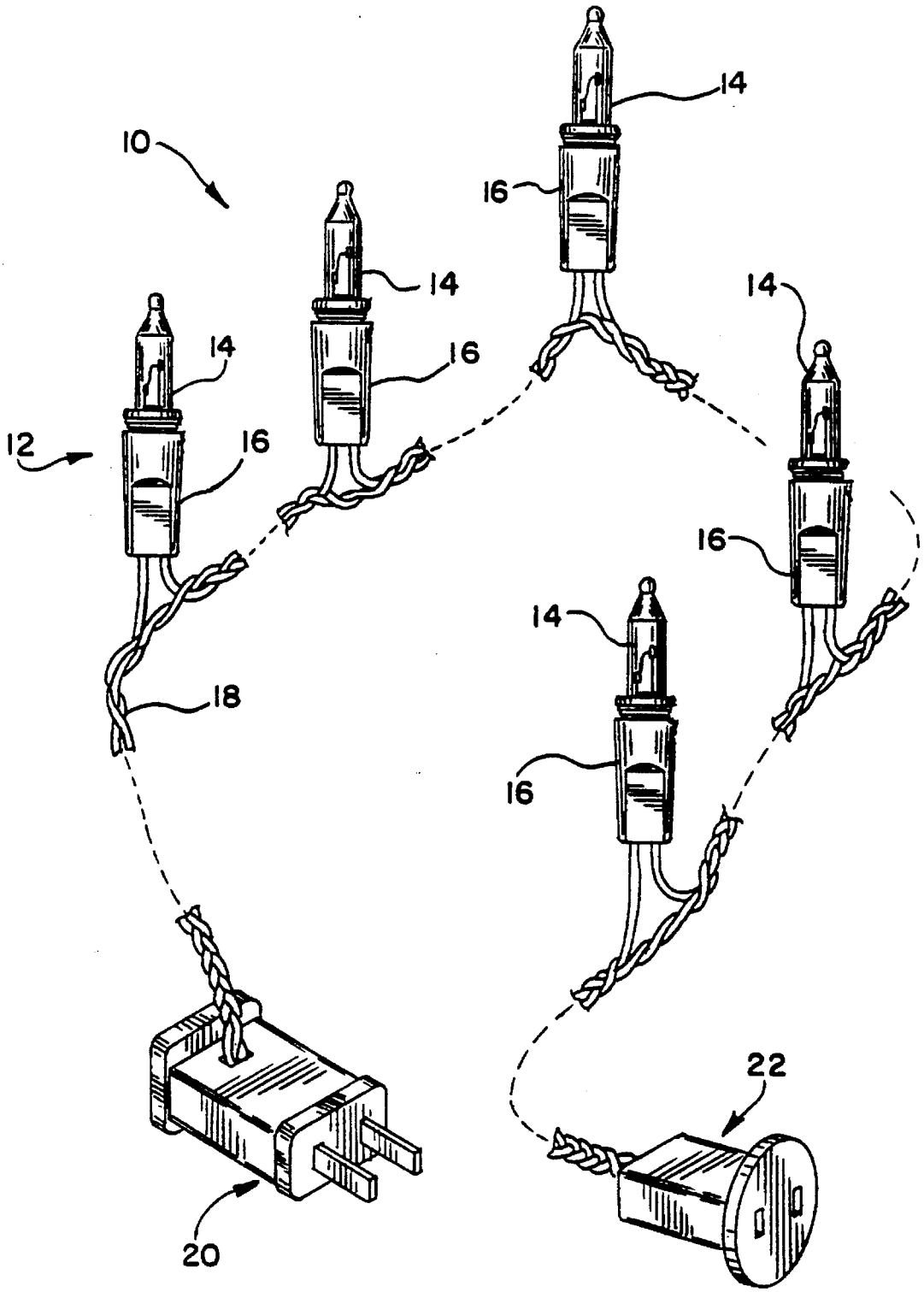
FIG. 1 is an enlarged perspective view, in section, of a decorative light string according to the invention.

Referring now to the drawings, FIG. 1 depicts a decorative light string 10 of the type used during the holidays in the ornamentation of Christmas trees, for example. The string 10 includes a plurality of lamps 12 made of bulbs 14 and their associated sockets 16 which, in turn, are electrically connected to each other in series by a power line 18. An end of the line 18 includes a plug 20 for connection to an electrical outlet and another end of the line 18 can include a receptacle 22 for connection of the string 10 to another like string, if desired.

Figure 2:
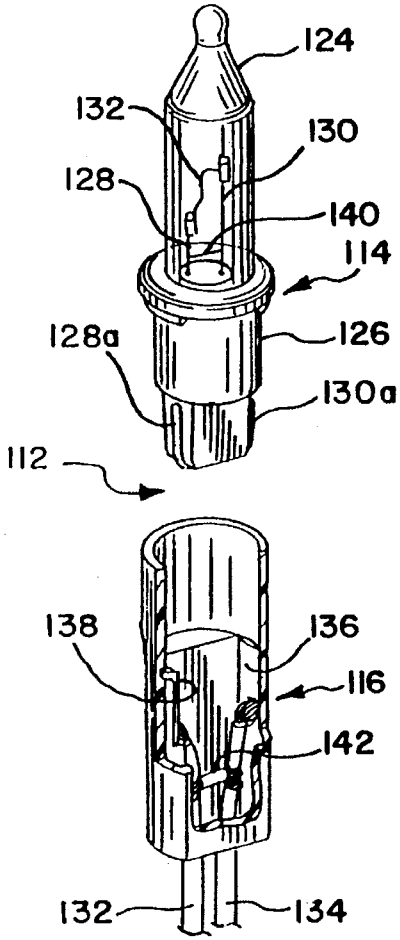
FIG. 2 is a side elevational view, partially exploded, showing a bulb and its associated socket and incorporating a shunt system according to one aspect of the invention.

The invention includes a shunt system incorporated within each of the individual incandescent lamps. FIG. 2, for example, illustrates a first preferred embodiment of the invention with the lamp 112 including a bulb member 114 and an associated socket 116. The bulb member 114, shown in exploded view over the socket 116 includes a bulb envelope 124 seated within a lamp holder 126. A pair of bulb wires 128 and 130 extend through the lamp holder 126 and into the bulb envelope 124. The wires 128 and 130 are made of an electrically conductive material and support the filament 132. The filament produces incandescent light and provides the path of least resistance for the flow of current through the lamp 112. The lamp wires 128 and 130 extend down through the bottom of the lamp holder 126 and the portions **128*a* and 130*a* provide electrical contact points when the lamp holder 126 is inserted within the socket 116**.

The socket 116 is configured to receive the lamp holder 126 therein. A pair of terminal wires 132 and 134 extend into the socket 116 from the power line 118 (FIG. 1). The terminal wires 132 and 134 are mechanically and electrically connected to electrical terminals 136 and 138 within the socket 116. The terminals 136 and 138 contact the bulb wire portions **128*a* and 130*a* when the lamp holder 126 is inserted within the lamp socket 116, typically in a frictional fit, to provide current to the filament 132. In this arrangement, current flows through the power line 18 and through the terminal wire 132 into the socket 116 to the terminal 138 and into the bulb member 114 through the bulb wire 128 and across filament 132 to produce incandescent light. Current continues to flow through the lamp 112 by passing through the lamp wire 130 and down through the terminal 136, exiting the socket 116 through terminal wire 134**. This flow of current is repeated for each of the individual bulb fixtures in the light string.

In an important aspect of the invention, a shunt system is provided having a first shunt 140 within the bulb envelope 124 and a second shunt 142 positioned in the lamp socket 116 and across the terminal wires 132, 134. The two shunts 140 and 142 are preferably made of breakdown materials so that the resistance across the shunts is initially greater than the resistance across the filament 132. In normal operation, current will flow through the power line and the bulb wires 128 and 130 and across the filament 132 to produce incandescent light within the bulb envelope 124. When the filament breaks, however, the increased voltage differential across the bulb lead wires 128 and 130 will begin to generate enough heat to cause the oxide coating of the shunts 140 and 142 to break down, resulting in a lowering of the resistance across the shunts to allow passage of current thereacross. The two shunts preferably operate in tandem to avoid excessive heat build up across either of the shunts.

In this arrangement, the series circuit of the light string 10 can be maintained in a closed and operative condition when one or more of the bulb filaments fail. The arrangement shown in FIG. 2 is also effective in shunting current in the event the bulb is broken and the first shunt 140 is destroyed. While the second shunt 142 is configured to handle the full current, some additional heat will be generated by the second shunt than would normally result when both shunts 140 and 142 are operable. The second shunt 142 shown in FIG. 2 will operate to keep the series circuit of the light string closed even if the bulb 114 is removed from its socket 116 as long as the shunt 142 remains in the socket 116 across the terminal wires 132, 134 to complete the circuit.

Figure 4:
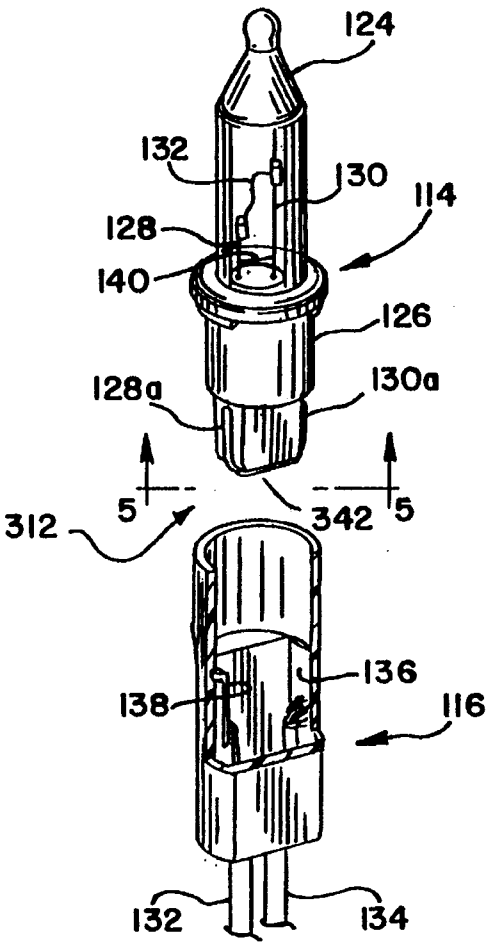
FIG. 4 is a side elevational view in section and partially exploded, showing a bulb and its associated socket and incorporating a bulb shunt system according to yet another aspect of the invention.
Figure 3:
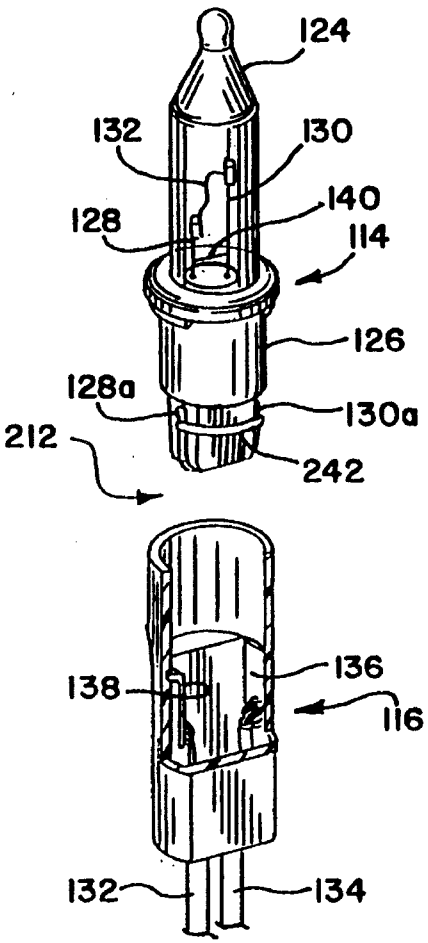
FIG. 3 is a side elevational view in section and partially exploded, showing a bulb and its associated socket and incorporating a bulb shunt system according to another aspect of the invention.
Figure 5:
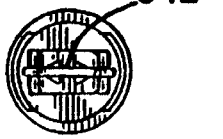
FIG. 5 is a bottom view of the bulb of FIG. 4 along the 5—5 line thereof.

FIGS. 3, 4 and 5 illustrate additional preferred embodiments of the invention. In referring now to these alternate embodiments, structural features common to all embodiments are indicated in the figures with identical reference numerals and are not discussed further. Only the differences of the various embodiments are described below.

Referring now to FIG. 3, a lamp 212 includes the components of the lamp 112 in FIG. 2, differing only in the placement of the second shunt 242, preferably shown in FIG. 3. The first shunt 140 remains within the bulb envelope 124 while the second shunt 242, preferably provided as a filament, is wrapped around the base of the lamp holder 126. In this arrangement, as in the arrangement shown in FIG. 2, two shunts 140 and 242 will operate to maintain the series circuit in a closed condition in the event filament 132 breaks. When the lamp 114 is seated within the socket 116, the second shunt is maintained in contact with the portions 128*a* and 130*a* of the bulb wires. Consequently, the second shunt is capable of maintaining a circuit if the bulb envelope 124, the filament 132 and the first shunt 140 are broken. Additionally if the bulb wire portions 128*a* and 130*a* are broken, become twisted or otherwise fail to make contact with the terminals 136 and 138 within the socket 116, the second shunt 242 will contact the terminals 136 and 138 to keep the circuit closed.

Referring to FIGS. 4 and 5, the second shunt 342 is placed outside of the bulb envelope 124 across the bulb lead wires 128 and 130 at the bottom of the lamp holder 126 (See FIG. 5) where the wires 128 and 130 enter the lamp holder 126. As is true in the other above-discussed embodiments, the embodiment depicted in FIGS. 4 and 5 also operates to maintain a closed series circuit in the event the bulb filament 132 breaks or in the event that the bulb envelope 124 is crushed, thereby destroying the first shunt 140 along with the filament 132.

It will be appreciated that while specific embodiments have been described, it is not intended that the invention be limited to the specific structure described herein. Rather, the invention is more broadly directed to a shunt system having at least two shunts; a first shunt within the bulb envelope and a second shunt located outside of the bulb envelope at a location either on the lampholder or in the associated socket. Although the preferred embodiments described herein include dual shunts made of a filamentous material, the described use of such a shunt material is not intended to be limiting in any way. The invention is directed to a dual shunt system incorporating shunts made of any appropriate material and performing the function described herein. While the shunts are preferably made of a filamentous material having suitable breakdown characteristics, those skilled in the art will appreciate that a range of materials are available and can be incorporated into the shunt system of the invention to achieve the described result.

While preferred embodiments of the present invention have been discussed and described in detail, those skilled in the art will appreciate that various changes and modifications can be made to the described embodiments without departing from the true spirit and scope of the invention, as defined in the appended claims.

I claim:

1. A light string having a plurality of lights connected in a circuit and including a shunt system to prevent the failure of the entire light string when a single light fails, the light string comprising:

a plurality of bulbs, each bulb having an envelope associated with a lampholder and including a pair of bulb wires extending through said lampholder and into said envelope, said bulb wires connected within said envelope by a filament and said wires and said filament being made of electrically conductive materials to produce light when electrical current passes therethrough;

a socket configured to retain said lampholder therein, said socket including a pair of terminal wires positioned for electrical contact with said bulb wires when said lampholder is positioned within said socket;

a power line electrically connecting said terminal wires in said bulbs in a series circuit, said power line including a plug for electrically connecting said power line to a power source;

a first shunt within said bulb electrically connecting said bulb wires; and a second shunt positioned outside of said bulb envelope and electrically connected to said bulb wires and said terminal wires and positioned to operate in tandem with said first shunt to maintain current flow through the light string in the event said filament breaks, said first shunt and said second shunt operating in tandem so as to prevent heat build-up at either of said shunts, said first shunt and said second shunt having a combined resistance so as to regulate current flow through the remaining bulbs in the event of filament rupture.

2. The light string of claim 1 wherein said first shunt and said second shunt are coated with a breakdown material to provide an initial resistance for said first shunt and said second shunt greater than the resistance of said filament, said first shunt and said second shunt having a post-breakdown resistance lower than said initial resistance after filament rupture and resulting breakdown of said breakdown material.

3. The light string as defined in claim 1, wherein said bulb wires within said lampholder include portions extending through an end of said lampholder opposite to said bulb envelope.

4. The light string as defined in claim 3, wherein said socket includes a pair of terminals in electrical communication with said terminal wires, said terminals providing electrical contact with said portions of said bulb wires when said lampholder is positioned within said socket.

5. The light string as defined in claim 1, wherein said socket is configured to retain said lampholder therein in a frictional fit.

6. The light string as defined in claim 1, wherein said second shunt is positioned within said socket to electrically connect said terminal wires so that, in the absence of a bulb retained within said socket, electrical current will flow through said second shunt in said socket.

7. The light string as defined in claim 1, wherein said second shunt is positioned around said lamp holder to maintain electrical contact with said terminal wires and said socket and with said lamp wires when said lamp holder is positioned within said socket.

8. The light string as defined in claim 1, wherein said second shunt is positioned on said lamp holder and connects said lamp wires.

9. A light string having a plurality of lights connected in a circuit and including a shunt system to prevent the failure of the entire light string when a single light fails, the light string comprising:

a plurality of bulbs, each bulb having an envelope associated with a lampholder and including a pair of bulb wires extending through said lampholder and into said envelope, said bulb wires connected within said envelope by a filament and said wires and said filament being made of electrically conductive materials to produce light when electrical current passes therethrough;

a socket configured to retain said lampholder therein, said socket including a pair of terminal wires positioned for electrical contact with said bulb wires when said lampholder is positioned within said socket;

a power line electrically connecting said terminal wires in said bulbs in a series circuit, said power line including a plug for electrically connecting said power line to a power source;

a first shunt within said bulb electrically connecting said bulb wires; and a second shunt positioned within said socket and electrically connected to said terminal wires, said second shunt constructed to operate in tandem with said first shunt to maintain current flow through the light string in the event said filament breaks or in the absence of a bulb retained within said socket, said first shunt and second shunt operating in tandem so as to prevent heat build-up at either of said shunts, said first shunt and said second shunt having a combined resistance so as to regulate current flow through the remaining bulbs in the event of filament rupture.

10. The light string of claim 9 wherein said first shunt and said second shunt are coated with a breakdown material to provide an initial resistance for said first shunt and said second shunt greater than the resistance of said filament, said first shunt and said second shunt having a post-breakdown resistance lower than said initial resistance after filament rupture and resulting breakdown of said breakdown material.

11. The light string as defined in claim 9, wherein said bulb wires within said lampholder include portions extending through an end of said lampholder opposite to said bulb envelope.

12. The light string as defined in claim 11, wherein said socket includes a pair of terminals in electrical communication with said terminal wires, said terminals providing electrical contact with said portions of said bulb wires when said lampholder is positioned within said socket.

13. A light string having a plurality of lights connected in a circuit and including a shunt system to prevent the failure of the entire light string when a single light fails, the light string comprising:

a plurality of bulbs, each bulb having an envelope associated with a lampholder and including a pair of bulb wires extending through said lampholder and into said envelope, said bulb wires connected within said envelope by a filament and said wires and said filament being made of electrically conductive materials to produce light when electrical current passes therethrough;

a socket configured to retain said lampholder therein, said socket including a pair of terminal wires positioned for electrical contact with said bulb wires when said lampholder is positioned within said socket;

a power line electrically connecting said terminal wires in said bulbs in a series circuit, said power line including a plug for electrically connecting said power line to a power source;

a first shunt within said bulb electrically connecting said bulb wires; and a second shunt positioned outside of said bulb envelope around said lampholder and electrically connected to said bulb wires to maintain electrical contact with said terminal wires within said socket, said second shunt positioned to operate in tandem with said first shunt to maintain current flow through the light string in the event said filament breaks, said first shunt and second shunt operating in tandem so as to prevent heat build-up at either of said shunts, said first shunt and said second shunt having a combined resistance so as to regulate current flow through the remaining bulbs in the event of filament rupture.

14. The light string of claim 9 wherein said first shunt and said second shunt are coated with a breakdown material to provide an initial resistance for said first shunt and said second shunt greater than the resistance of said filament, said first shunt and said second shunt having a post-breakdown resistance lower than said initial resistance after filament rupture and resulting breakdown of said breakdown material.

15. The light string as defined in claim 13, wherein said bulb wires within said lampholder include portions extending through an end of said lampholder opposite to said bulb envelope.

16. The light string as defined in claim 15, wherein said socket includes a pair of terminals in electrical communication with said terminal wires, said terminals providing electrical contact with said portions of said bulb wires when said lampholder is positioned within said socket.

17. A light string having a plurality of lights connected in a circuit and including a shunt system to prevent the failure of the entire light string when a single light fails, the light string comprising:

a plurality of bulbs, each bulb having an envelope associated with a lampholder and including a pair of bulb wires extending through said lampholder and into said envelope, said bulb wires connected within said envelope by a filament and said wires and said filament being made of electrically conductive materials to produce light when electrical current passes therethrough;

a socket configured to retain said lampholder therein, said socket including a pair of terminal wires positioned for electrical contact with said bulb wires when said lampholder is positioned within said socket;

a power line electrically connecting said terminal wires in said bulbs in a series circuit, said power line including a plug for electrically connecting said power line to a power source;

a first shunt within said bulb electrically connecting said bulb wires; and a second shunt positioned outside of said bulb envelope and connecting said bulb wires, said second shunt positioned to operate in tandem with said first shunt to maintain current flow through the light string in the event said filament breaks, said first shunt and said second shunt operating in tandem so as to prevent heat build-up at either of said shunts, said first shunt and said second shunt having a combined resistance so as to regulate current flow through the remaining bulbs in the event of filament rupture.

18. The light string of claim 9 wherein said first shunt and said second shunt are coated with a breakdown material to provide an initial resistance for said first shunt and said second shunt greater than the resistance of said filament, said first shunt and said second shunt having a post-breakdown resistance lower than said initial resistance after filament rupture and resulting breakdown of said breakdown material.

19. The light string as defined in claim 17, wherein said bulb wires within said lampholder include portions extending through an end of said lampholder opposite to said bulb envelope.

20. The light string as defined in claim 19, wherein said socket includes a pair of terminals in electrical communication with said terminal wires, said terminals providing electrical contact with said portions of said bulb wires when said lampholder is positioned within said socket.

* * * * *